US011208777B2

(12) United States Patent
Briggs

(10) Patent No.: US 11,208,777 B2
(45) Date of Patent: Dec. 28, 2021

(54) DOWN PRESSURE PLOW SYSTEM WITH FLOAT FUNCTION

(71) Applicant: Polaris Industries Inc., Medina, MN (US)

(72) Inventor: Robert C. Briggs, Lake Havasu City, AZ (US)

(73) Assignee: Polaris Industries Inc., Medina, MN (US)

( * ) Notice: Subject to any disclaimer, the term of this patent is extended or adjusted under 35 U.S.C. 154(b) by 286 days.

(21) Appl. No.: 16/239,136

(22) Filed: Jan. 3, 2019

(65) Prior Publication Data

US 2020/0217030 A1 Jul. 9, 2020

(51) Int. Cl.
*E01H 5/06* (2006.01)

(52) U.S. Cl.
CPC ..... *E01H 5/062* (2013.01); *E01H 5/066* (2013.01)

(58) Field of Classification Search
CPC ..... E01H 5/062; E01H 5/066
See application file for complete search history.

(56) References Cited

U.S. PATENT DOCUMENTS 2,775,830 A * 1/1957 Kenyon ..... E01H 5/063 37/232

* cited by examiner

*Primary Examiner* — Tara Mayo-Pinnock
(74) *Attorney, Agent, or Firm* — Harness, Dickey & Pierce P.L.C.

(57) ABSTRACT

A down pressure plow system with a float function is disclosed for use in a vehicle. The plow system includes a plow frame assembly and a plow blade carried by the plow blade assembly. An actuator is configured to move the plow blade up and down. A down pressure linkage is coupled to the plow frame assembly. The down pressure linkage applies a downward force to the plow blade upon actuating the actuator to move the plow blade and simultaneously allows the plow blade to move upward upon an upward force being applied to the plow blade.

18 Claims, 11 Drawing Sheets

DOWN PRESSURE PLOW SYSTEM WITH FLOAT FUNCTION

FIELD

The present disclosure relates to a plow system and, more particularly, to a down pressure plow system having a float function for use with a vehicle.

BACKGROUND

This section provides background information related to the present disclosure which is not necessarily prior art.

Plows for vehicles, particularly, snow plows for utility vehicles, are known in the art. Many of these plows are raised and lowered by way of a hydraulic cylinder ram coupled between a push frame assembly and a lift arm assembly. The lift arm assembly may include a flexible strap that connects from the lift arm assembly to the plow. This assembly allows the hydraulic cylinder ram to raise and lower the plow by the flexible strap.

Such plow systems rely only on the weight of the plow and gravity to apply a downward force to the snow or other debris to be plowed. The flexible strap does not provide any downward force due to the flexible nature of the strap. Unfortunately, depending on the type of snow, such as wet, heavy snow, the downward force by the weight of the plow and gravity may not be sufficient to remove all of the snow from the underlying pavement. Also, buildup of packed snow and ice may simply cause the plow to float over this layer leaving the pavement still covered.

Moreover, it may sometimes be desirable to use the plow to pull snow away from areas, such as in front of garage doors, sometimes referred to as back dragging. Here again, however, with heavy snow, typical plows tend to float over the snow as opposed to pulling the snow away from the desired areas. Therefore, it would be desirable to provide a plow that can provide sufficient downward pressure with an upward float function to overcome the noted deficiencies of existing plows.

SUMMARY

This section provides a general summary of the disclosure, and is not a comprehensive disclosure of its full scope or all of its features.

A plow system is disclosed for use on a vehicle. The plow system includes a plow frame assembly and a plow blade that is carried by the plow frame assembly. An actuator moves the plow blade up and down. A down pressure linkage is coupled to the plow frame assembly. The down pressure linkage applies a downward force to the plow blade upon actuating the actuator to move the plow blade down and simultaneously allows the plow blade to move upward upon an upward force being applied to the plow blade.

The plow system for use in the vehicle includes a plow frame assembly and a plow blade that is carried by the plow frame assembly. A hydraulic cylinder moves the plow blade up and down. A coil over gas shock is coupled to the plow frame assembly. The coil over gas shock applies a downward force to the plow blade upon the plow blade engaging a surface, while simultaneously allowing the plow blade to move upward upon an upward force being applied to the plow blade while engaging the surface.

The plow system for use in a vehicle includes a plow bumper. A push frame is pivotably coupled to the plow bumper and a lift arm assembly is pivotably coupled to the plow bumper. A plow blade is carried by the push frame. An actuator is pivotably coupled between the lift arm assembly and the push frame to move the plow blade up and down. A down pressure linkage is pivotably coupled between the lift arm assembly and the push frame. The down pressure linkage applies a downward force to the plow blade upon the plow blade engaging a surface while simultaneously allowing the plow blade to move upward while the downward force is being applied upon an upward force being applied to the plow blade from the surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
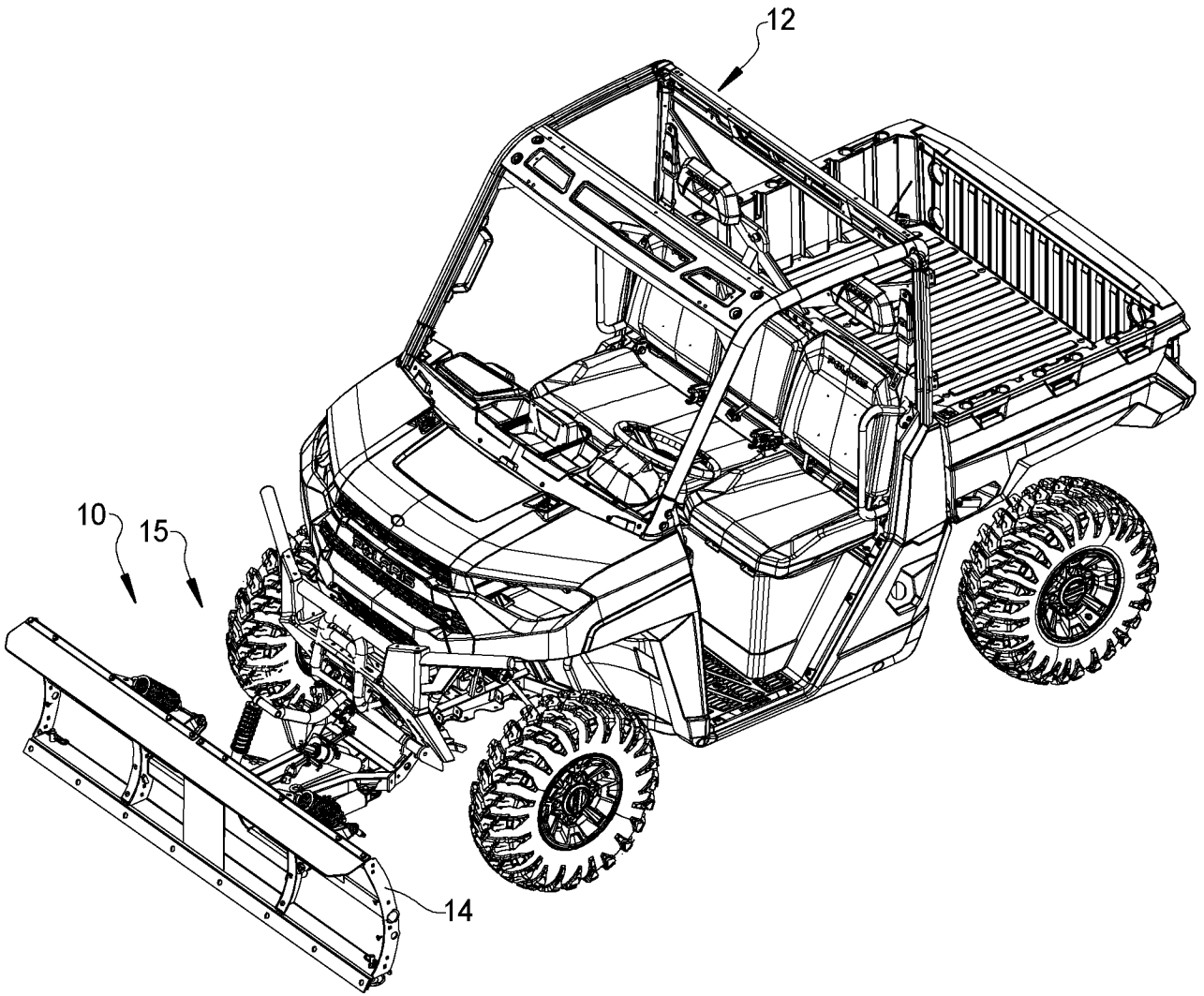
FIG. 1 is a front perspective view of an off-road vehicle or utility vehicle having a plow assembly of the present disclosure.
Figure 2:
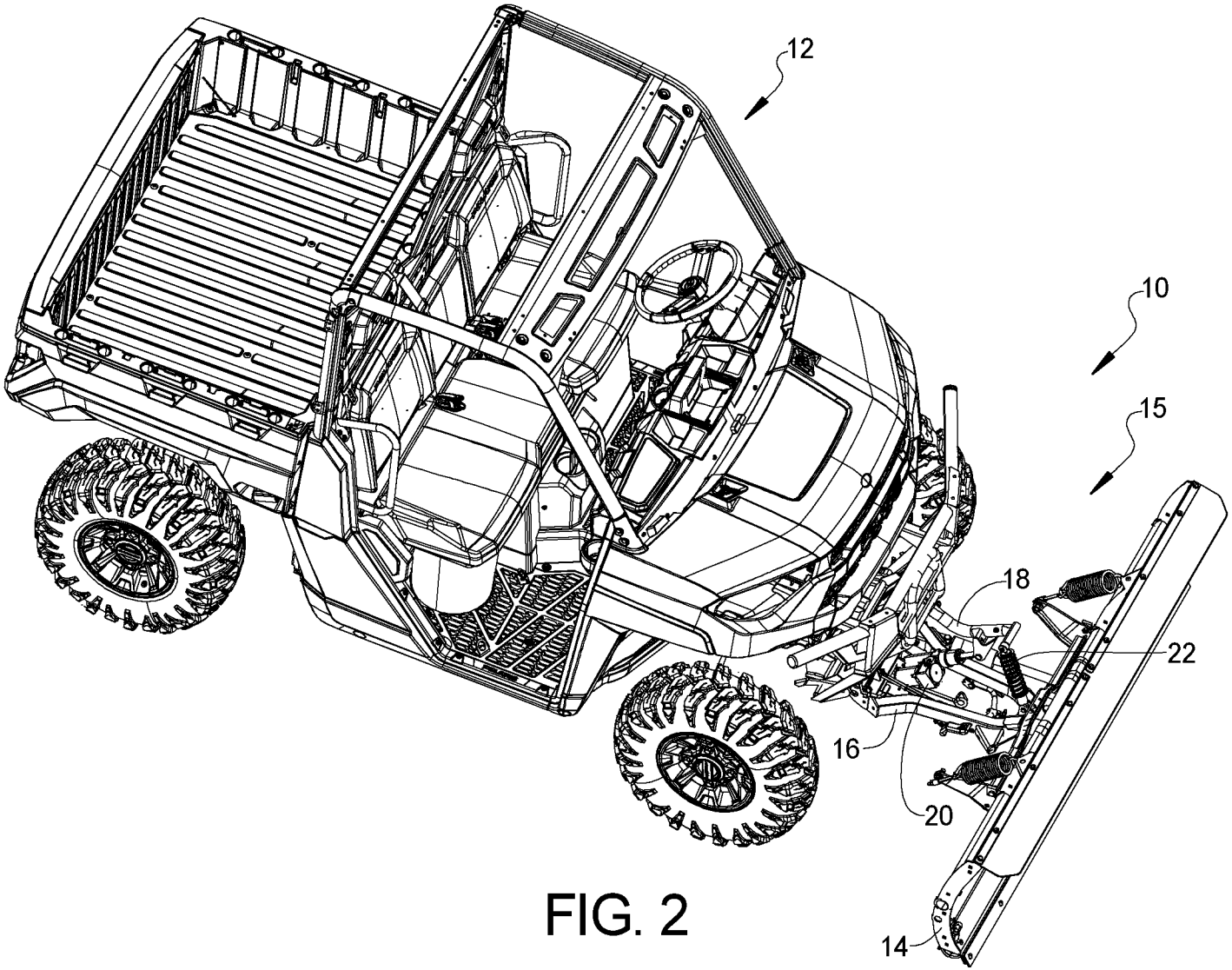
FIG. 2 is another perspective view of the vehicle of FIG. 1.

FIG. 1 illustrates a plow assembly or system 10 associated with an off-road or utility vehicle 12. While the off-road vehicle 12 illustrated can be a Polaris Ranger® utility vehicle, sometimes also referred to as a side-by-side vehicle, any type of vehicle can utilize the plow system 10. For example, a plow system associated with a Polaris Sportsman® ATV or other utility vehicle can also utilize the plow system 10 of the present disclosure. Additionally, the underlying plow frame and plow can be a Polaris GlacierPro® HD system, offered by Polaris Industries of Medina, Minn., that incorporates the teachings of the present disclosure.

As illustrated in FIGS. 1-4, the plow system 10 is removably coupled to the vehicle 12, as is known in the art and discussed herein. In general, the plow system 10 includes a plow blade 14 carried by a plow frame assembly 15. The plow frame assembly 15 includes a push frame 16 and a lift arm assembly 18. The plow blade 14 and push frame 16 is raised and lowered by the lift arm assembly 18 and an actuator or hydraulic cylinder ram 20. Positioned between the lift arm assembly 18 and the push frame 16 is a biasing member, a down pressure linkage or down pressure/float assembly 22, further discussed herein.

Figure 3:
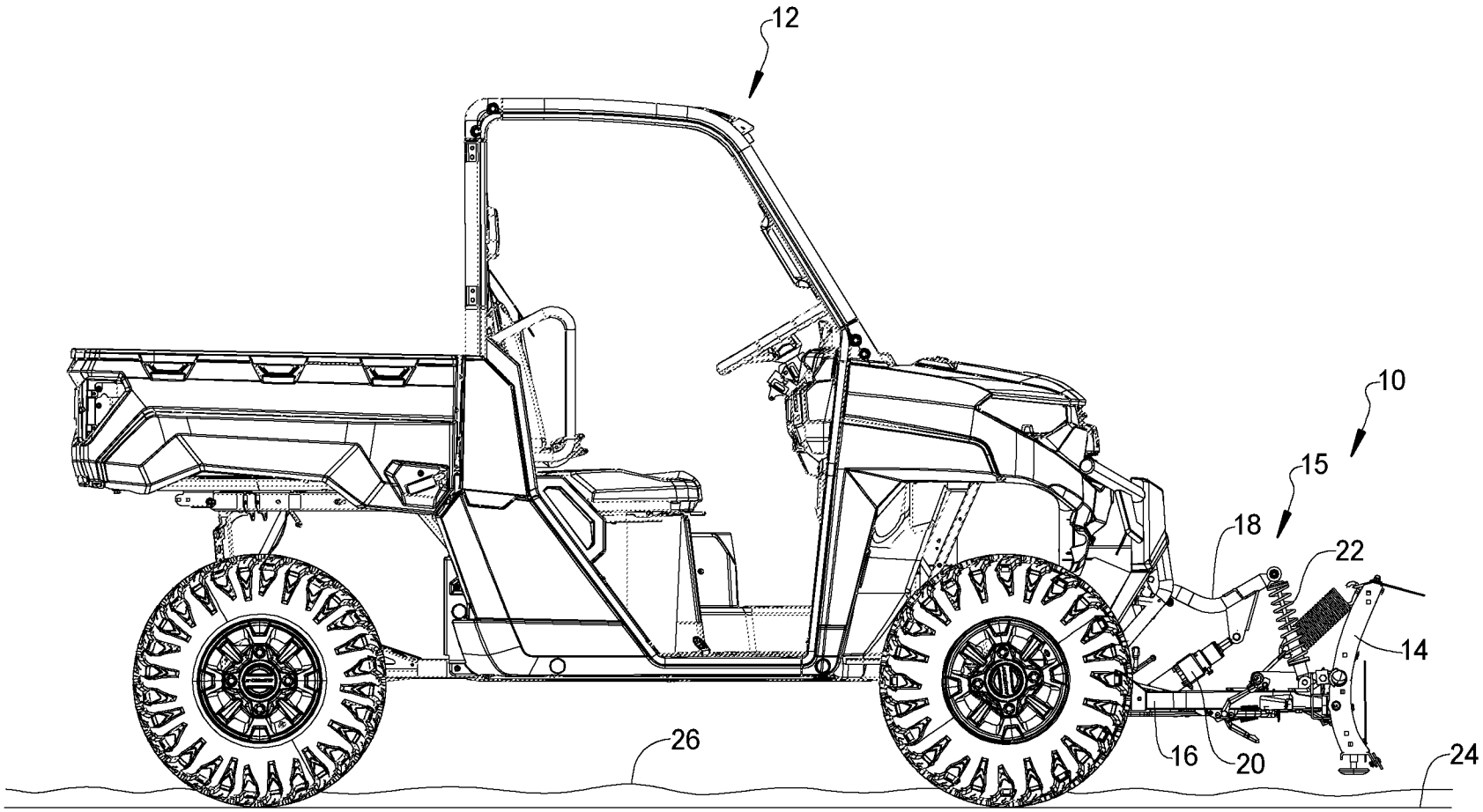
FIG. 3 is a side view of the vehicle of FIGS. 1 and 2, with the plow assembly shown in a raised position.
Figure 4:
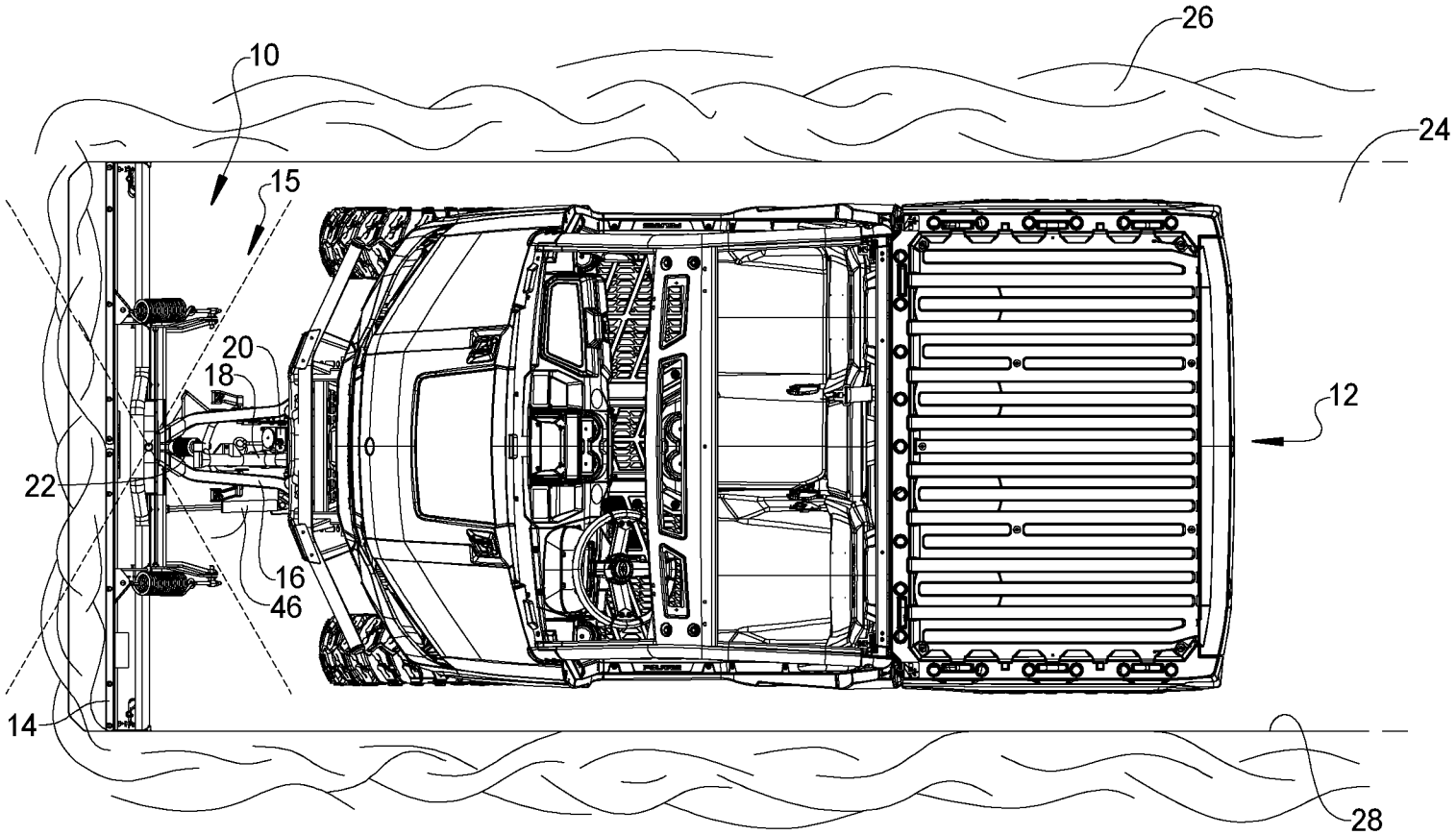
FIG. 4 is a top elevational view looking down on the vehicle of FIG. 1, with the plow assembly illustrated in the lowered position and shown plowing snow from pavement.
Figure 5:
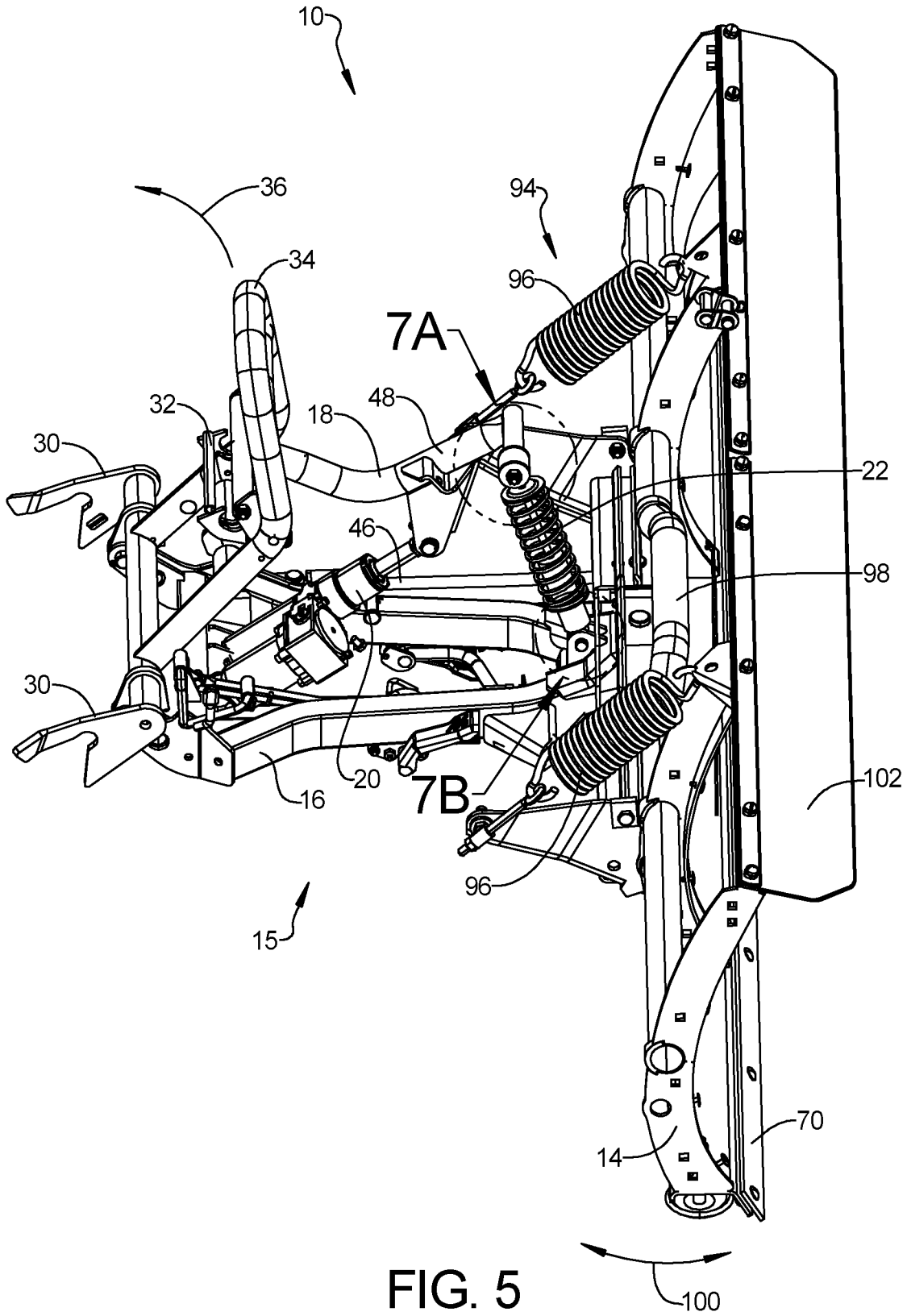
FIG. 5 is a perspective view of the plow assembly of the present disclosure.

As illustrated in FIG. 3, the vehicle 12 is shown with the plow assembly 10 in a raised intermediate position. In this position, the plow blade 14 is raised above the pavement 24 so as to not be in contact with the pavement 24. A layer of snow 26 is illustrated atop the pavement 24, before the plow blade 14 moves the snow 26. With reference to FIG. 4, the vehicle 12 is illustrated with the plow assembly 10 in a down position and in contact with the pavement 24. In this view, the plow blade 14 is illustrated removing or pushing the snow 26 from the pavement 24 leaving a clear path 28 where the snow 26 is substantially fully removed from the pavement 24. Such a result is achieved because of the down pressure/float assembly 22, further discussed herein.

Referring now to FIGS. 5-7B, the plow system 10 is illustrated in further detail. As noted above, the plow system 10 includes the plow blade 14 and the plow frame assembly 15 having the push frame 16 and lift arm assembly 18. Positioned between the lift arm assembly 18 and the push frame 16 is the actuator or hydraulic cylinder ram 20 and the down pressure/float assembly 22. The plow system 10 is removably attached to the vehicle 12 by way of a first pair of coupling arms 30 and a second pair of coupling arms 32. The first pair of coupling arms 30 engage a first pair of lower pins (not shown) fixed to the vehicle 12 and the second pair of coupling arms 32 engage an upper bar (not shown) fixed to the vehicle 12. In this regard, the first pair of arms 30 are positioned over the pins to rotatably engage the pins. A plow bumper 34 coupled to the first pair of coupling arms 30 and the second pair of coupling arms 32 is pivoted upward about the pins in pivot direction 36 until the second pair of coupling arms 32 can be pivotably locked to the vehicle 12. The illustrated coupling is similar to the GlacierPro® HD plow offered by Polaris Industries of Medina, Minn. It should also be noted, however, that the plow system 10 can be attached to the vehicle 12 in any conventional manner and either be designed as a quick connect or coupling plow or a permanently attached plow system.

Figure 6:
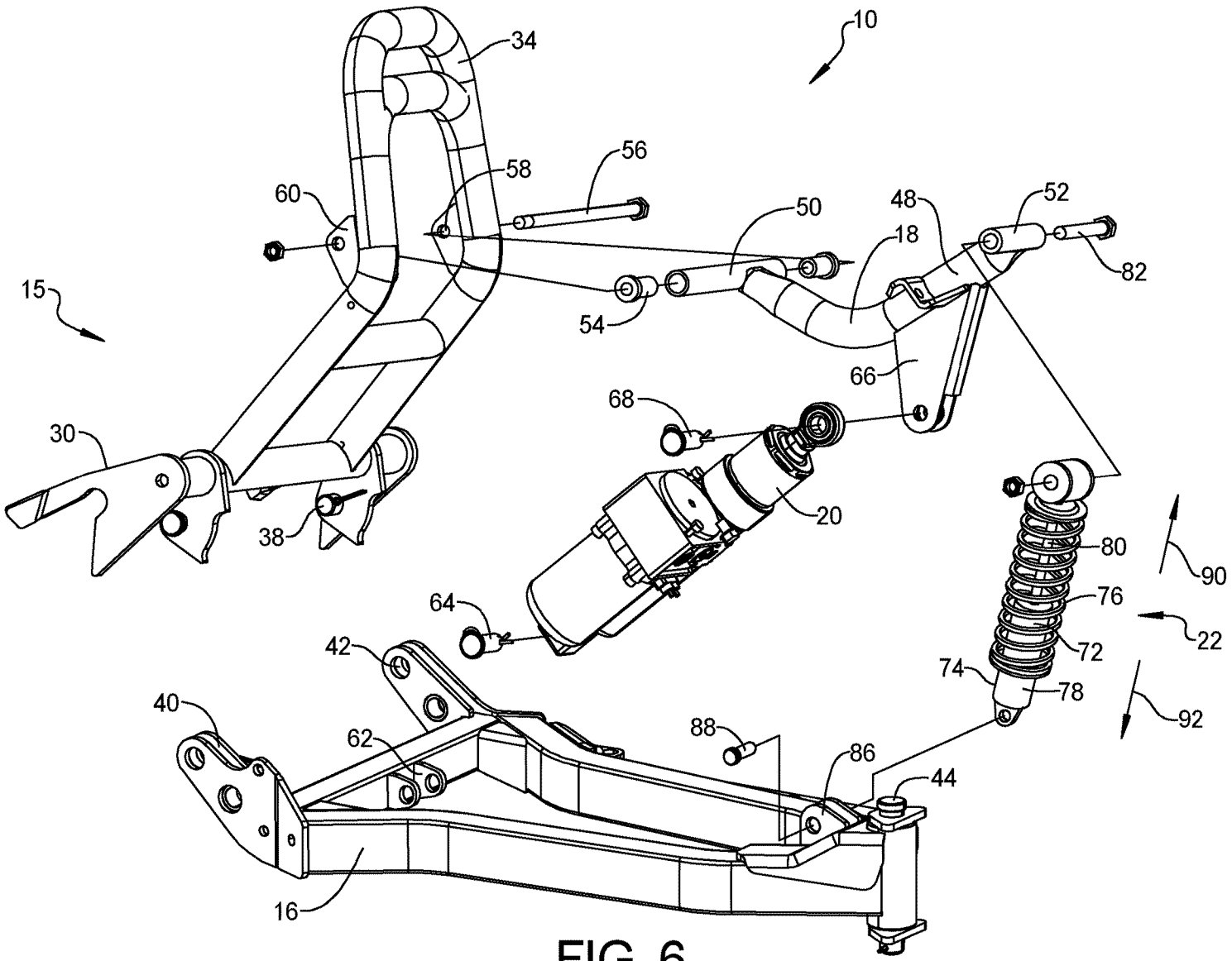
FIG. 6 is an exploded perspective view of a portion of the plow assembly of FIG. 5.
Figure 7A:
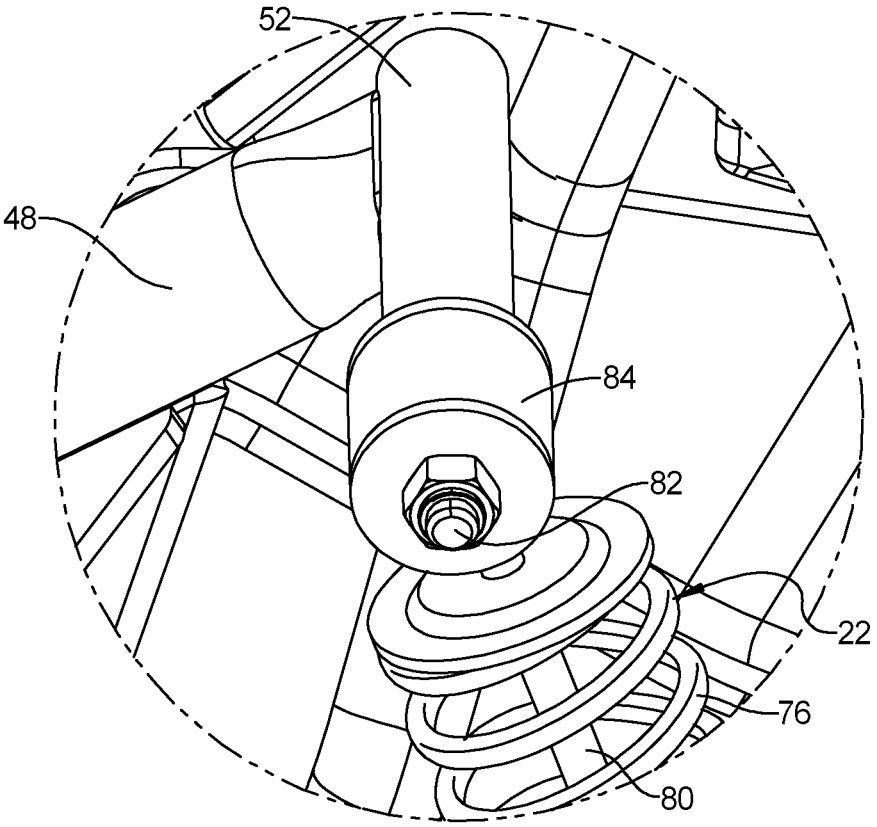
FIG. 7A is an enlarged perspective view of a coil over gas shock attached to a lift arm of the plow assembly.
Figure 7B:
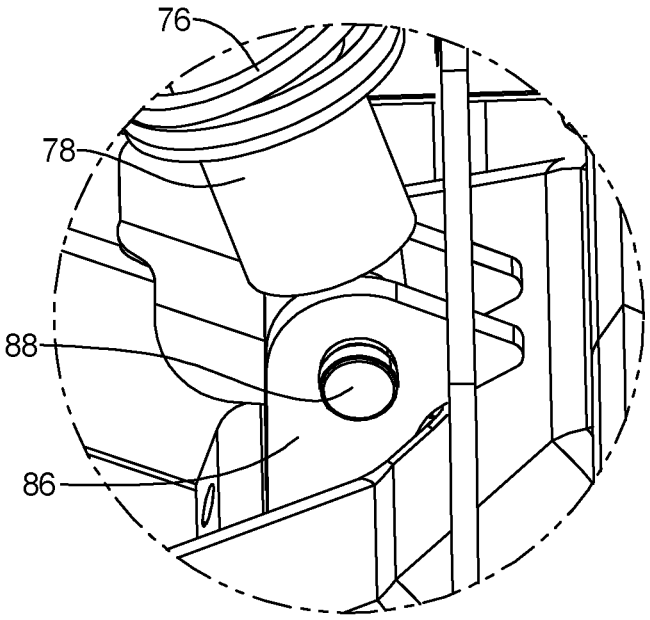
FIG. 7B is an enlarged perspective view of another end of the coil over gas shock attached to a push frame of the plow assembly.

The push frame 16, as illustrated in FIG. 6, is pivotably attached to the plow bumper 34 by way of a pair of quick connect pins 38 that attach to a pair of coupling flanges 40. Each coupling flange 40 includes a coupling hole 42 that receives a corresponding pin 38. The plow blade 14 is pivotably attached to the push frame 16 using pivot pin 44, as shown in FIG. 6. The pair of quick connect pins 38 enables the push frame 16 to move up and down or pivot relative to the quick connect pins 38 attached to the plow bumper 34. The plow blade 14 can pivot right-to-left about pivot pin 44 to direct the snow either to the right, left, or straight relative to the vehicle 12, as shown in phantom in FIG. 4. In order to steer the plow blade 14 to the right or left, a secondary actuator hydraulic cylinder 46 is attached between the push frame 16 and the plow blade 14. This hydraulic cylinder 46 can extend or retract to move the plow blade 14 to pivot right or pivot left about pivot pin 44 relative to the vehicle 12. As an alternative to the hydraulic cylinder 46, a manual steering mechanism can also be employed.

Pivotably coupled to the plow bumper 34 is the lift arm assembly 18. In other words, the lift arm assembly 18 is coupled to the plow bumper 34 at a pivot point. The lift arm assembly 18 includes a lift arm 48 that extends between a pivot tube 50 and an attachment tube 52. The pivot tube 50 includes a pair of bushings 54 that receives a bolt assembly 56 through a pair of holes 58 in attachment flanges 60.

In order to raise or lower the plow blade 14, the hydraulic cylinder ram 20 is positioned between the lift arm assembly 18 and the push frame 16 of the plow frame assembly 15. A lower portion of the hydraulic cylinder ram 20 is pivotably attached to a pair of flanges 62 attached to the push frame 16 by way of a bolt or pin 64. An upper portion of the hydraulic cylinder ram 20 is pivotably attached to the lift arm assembly 18 at coupling flange 66 with bolt or pin 68. The hydraulic cylinder ram 20 is an electric over hydraulic cylinder ram. In this regard, an electric motor driven by the vehicle's battery and alternator drive a hydraulic pump to move the hydraulic cylinder between an extended to a retracted position. In order to raise the plow blade 14, the hydraulic cylinder ram 20 is actuated to its extended position, thereby moving the lift arm assembly 18 as it pivots about bolt assembly 56.

Additionally, in order to raise the plow blade 14 that is attached to the push frame 16, the down pressure/float assembly 22 is also employed. The down pressure linkage or down pressure/float assembly 22 is able to provide or apply a downward force or pressure to a cutting edge 70 of the plow blade 14, while simultaneously allowing for an upward movement or float, further discussed herein. The down pressure/float assembly 22, as illustrated, is a coil over gas shock assembly 72, including a gas shock 74 and a coil spring 76 mounted thereto. The gas shock absorber 74 includes a cylindrical pressurized housing 78 with a reciprocating and moving shaft 80. Positioned over this assembly is the coil spring 76 that can adjustably provide a varying level of downward force, further discussed herein. The shaft 80 at the top of the coil over gas shock assembly 72 is attached to the attachment tube 52 by way of bolt or pin 82 and bushing 84. The lower portion of the coil over gas shock assembly 72 or the housing 78 is attached to a pair of flanges 86 by way of bolt or pin 88. While bolts 82 and 88 are illustrated, quick coupling pins could replace the noted bolts for ease of assembly and removal of the plow system 10.

The coil over gas shock assembly 72 can be a conventional vehicle coil over gas shock used in known vehicle suspension systems, such as a Polaris Youth ATV gas shock offered by Polaris Industries of Medina, Minn., and can be adjustable by way of adjustably preloading the coil spring 76 about the shock absorber 74, as is known in the art. In this regard, a separate collar moves relative to the body of the shock absorber 74 that compresses/decompresses the spring 76. This, in turn, adjusts the force needed to overcome the spring 76 and allow the shock 77 to move. This preloads the spring 76 making it stiffer at the same sag or resting weight. As illustrated, the coil over gas shock assembly 72 pivots about its two mounting points relative to the lift arm assembly 18 and the push frame 16 in order to raise and lower the plow blade 14.

Briefly, in order to raise the plow blade 14, the hydraulic cylinder ram 20 is pressurized to extend the hydraulic cylinder 20, thereby pivoting the lift arm assembly 18 upward, causing the semi-rigid down pressure linkage of the down pressure/float assembly 22 to pull upward on the push frame 16, thereby raising the plow blade 14. During this movement, an upward force or travel 90 by the down pressure linkage 22 is provided to the plow blade 14. In order to lower the plow blade 14, the hydraulic cylinder ram 20 is retracted, thereby pivoting the lift arm assembly 18 downward and causing the down pressure/float assembly 22 to provide a downward force 92 to the push frame 16 and the plow blade 14.

By providing a substantially or semi-rigid link having a float function between the lift arm assembly 18 and the push frame 16, a larger downward force 92 can be provided to the plow blade 14, as compared to simply relying on the weight of the plow blade 14 and gravity. In other words, by retracting the hydraulic cylinder 20, the lift arm assembly 18 is pulled downward, resulting in the coil over gas shock assembly 72 pushing the push frame 16 in a downward direction with the downward force 92, enabling the plow blade 14 to more efficiently plow the pavement 24. By additionally providing the down pressure linkage 22 that includes a float option, this enables an upward force 90 to be absorbed by the down pressure linkage 22, should the plow blade 14 hit or engage an obstacle, thereby allowing the upward force 90 to overcome the downward force 92 to compress the coil over gas shock assembly 72 without damaging the plow system 10. By providing this rebounding feature, the longevity of the blade 14 and plow system 10 is increased. Also, if the upward force or movement is too great to overcome with travel of the shock 74, a trip edge mechanism 94 will take over to protect the plow system 10.

Such a configuration also enables substantially the entire weight of the vehicle 12 to be placed onto the plow blade 14. For example, with the vehicle 12 sitting in a parked or static position, the hydraulic cylinder ram 20 is almost capable of raising the front wheels of the vehicle 12 when the plow blade 14 engages the pavement 24, thereby providing a significant downward force 92 to the plow blade 14 to provide clean plowing and removal of snow and ice to prepare a clean path 28.

The plow system 10 also allows the plow to function like a conventional plow by having the trip edge mechanism 94 to ensure that the plow system 10 is not damaged if the plow blade 14 hits an obstacle, such as a rock, curb, or other debris. In this regard, the trip edge mechanism 94 includes a pair of trip springs 96 and a torsion spring 98 that allows the plow blade 14 to pivot about direction 100. In other words, the cutting edge 70 can pivot closer to the vehicle 12 while the top edge 102 of the plow blade 14 pivots further away from the vehicle 12 upon the cutting edge 70 engaging debris or an obstacle. This stretches the trip springs 96 and provides a rotational torque on torsion spring 98 upon hitting debris. Such a function is not inhibited or altered by way of the down pressure/float assembly 22, thereby further ensuring efficient operation of the plow system 10.

Turning now to FIGS. 8A-8D, use of the plow system 10 with the down pressure linkage or down pressure/float assembly 22 is further discussed in detail. Here again, the down pressure/float assembly 22 is a coil over gas shock assembly 72 that allows the plow system 10 to apply a downward force or pressure to the cutting edge 70 of the plow blade 14, but still allow vertical movement or rebounding (i.e. upward force 90) for unseen changes or obstacles in the terrain or pavement 24. The pressure provided is proportionate to the size of the system being used. For example, a side by side configuration will generate more downward force than an ATV configuration. In other words, the downward force or pressure depends on the size/weight of the system/vehicle being used. The downward force also depends on the assembly 72 being used, since such assemblies are all rated for certain strengths and load depending on each vehicle. Again, this down force or pressure 92 is achieved by providing the coil over gas shock assembly 72 coupled between a first pivot point 102 on the lift arm assembly 18 and a second pivot point 104 on the push frame 16.

Figure 8A:
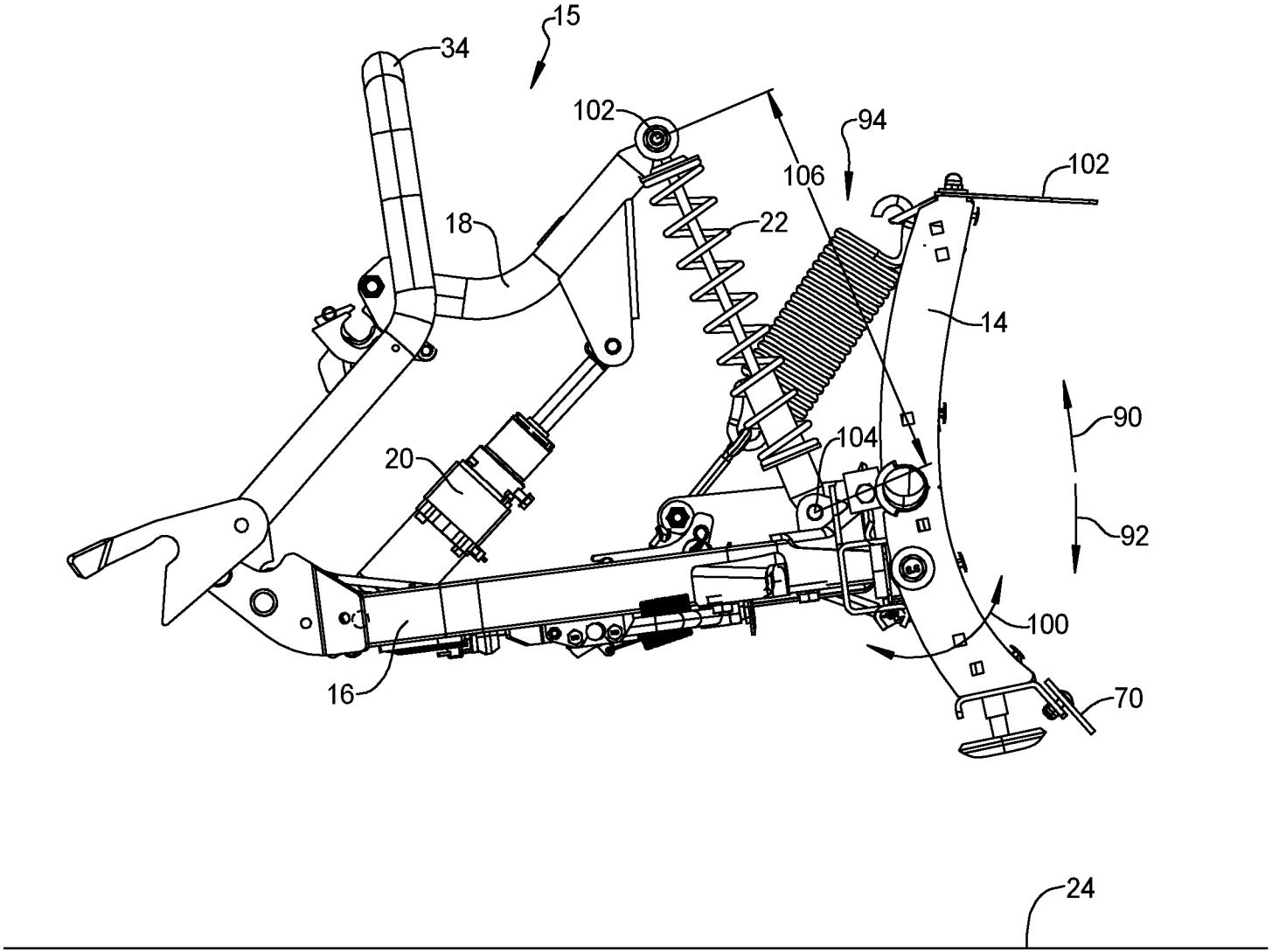
FIG. 8A is a side view of the plow assembly, illustrated in the raised position without the vehicle shown.

As illustrated in FIG. 8A, the plow system 10 is shown with the plow blade 14 in its fully upright position. In this position, the coil over gas shock assembly 72 is in its fully extended position (i.e. expanded substantially to its maximum length), while the lift arm assembly 18 is pivoted upward carrying the push frame 16 and the plow blade 14 also upward. In this position, the hydraulic cylinder ram 20 is also in its fully extended position and the coil spring 76 is substantially uncompressed. At this position, a first length 106 exists between first pivot point 102 and second pivot point 104.

Figure 8B:
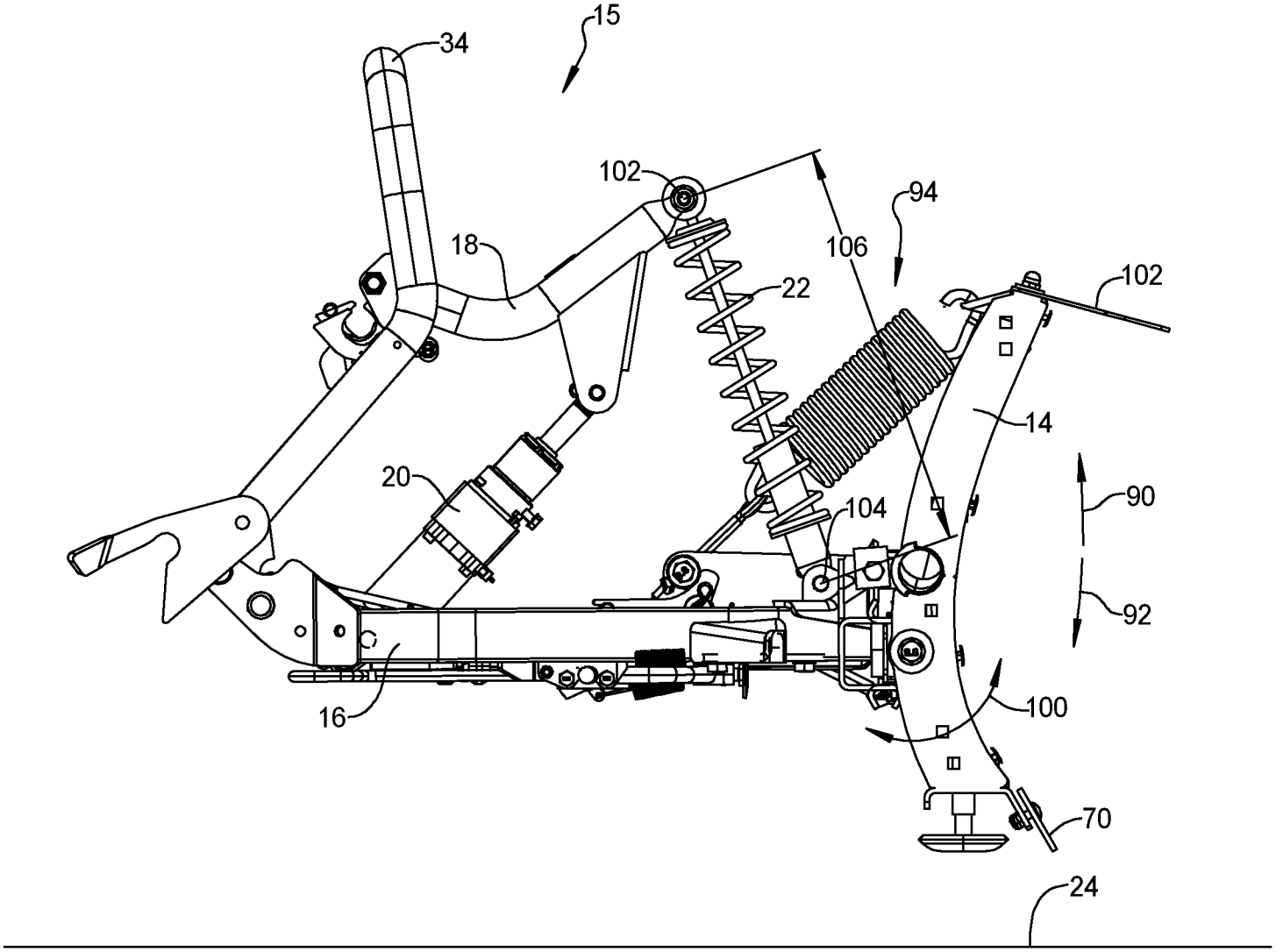
FIG. 8B is a side view of the plow assembly in an intermediate position.
Figure 8C:
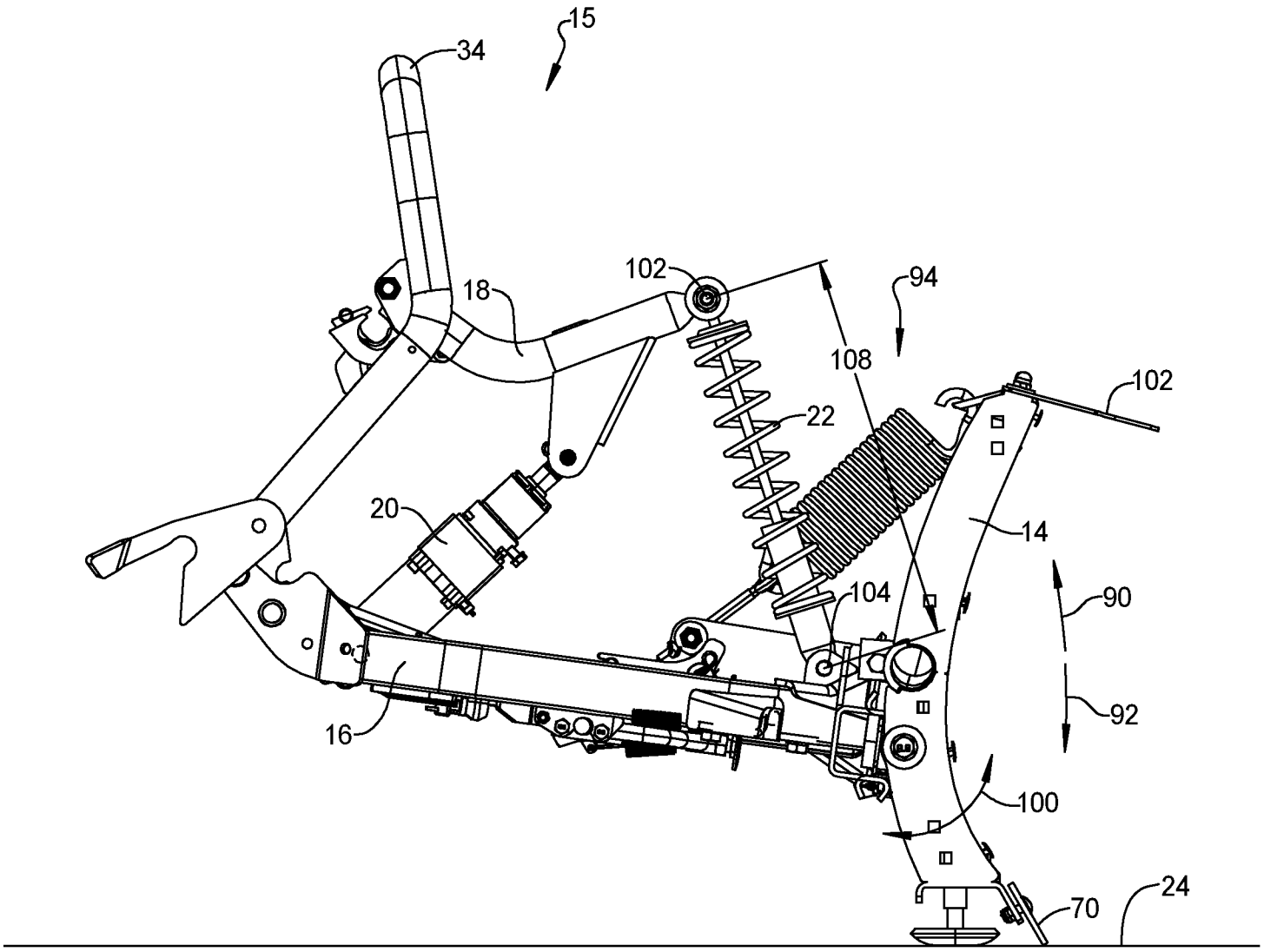
FIG. 8C is a side view of the plow assembly in the downward position.
Figure 8D:
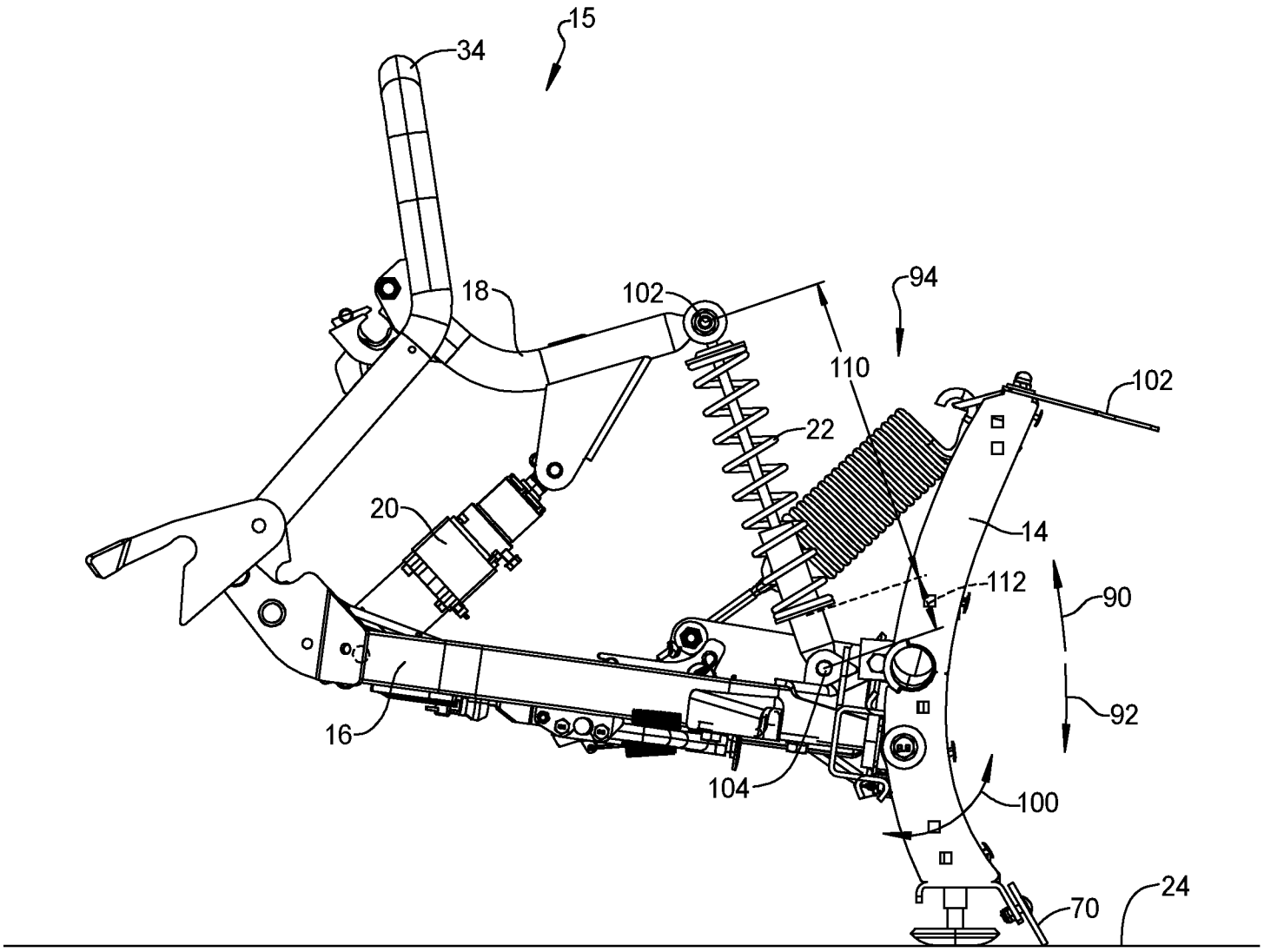
FIG. 8D is a side view of the plow assembly in the downward position, illustrated with the down pressure linkage in its substantially fully compressed position.

As the plow system 10 is lowered to an intermediate position, as shown in FIG. 8B, the hydraulic cylinder ram 20 is starting to retract, thereby lowering the lift arm assembly 18, the push frame 16, and the plow blade 14. As illustrated in FIG. 8C, the plow blade 14 is illustrated initially engaging the pavement 24 with the hydraulic cylinder ram 20 almost to its fully retracted position. In this initial engagement position, a second length 108 that is less than the first length 106 exists between the first pivot point 102 and the second pivot point 104 of the down pressure linkage 22. Upon initial contact of the cutting edge 70 with the pavement 24, the hydraulic cylinder ram 20 is still able to further retract to provide the downward force 92 onto the plow blade 14, thereby compressing the coil over shock assembly 72 to a final length 110 that is less than the first and second lengths 106 and 108, as shown in FIG. 8D.

In this position, the coil spring 76 and the gas shock 74 are compressed, as illustrated, because of the downward force from the lift arm 48 and hydraulic cylinder ram 20 and the upward force of the pavement 24 on the plow blade 14. This provides a downward force to the cutting edge 70 to allow for removal of heavy snow and ice and scraping of the pavement 24 without floating over the snow and ice like conventional plows. Since the coil over gas shock assembly 72 includes further retraction clearance, at the final length 110, further upward clearance, rebounding, or float is available should the cutting edge 70 engage an obstacle or debris. In this regard, assuming that the lift arm assembly 18 is fixed and does not move further upward or downward, the coil over gas shock assembly 72 allows additional upward travel 112, while simultaneously providing the downward force to enable the plow system 10 to operate smoothly and efficiently while also not affecting the trip edge mechanism 94. This also allows the plow blade 14 to provide for efficient back dragging of snow since the plow blade 14, again, will not float over heavy snow or ice. Additionally, as noted above, the coil over gas shock assembly 72 can be adjusted similar to other coil over gas shocks by simply compressing the coil spring 72 relative to the shock absorber 74 to provide an adjustable range of downward force for operating the plow system 10. Such downward force would not be available with a conventional strap or chain between the lift arm 48 and the push frame 16.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A plow system for use on a vehicle, comprising:

a plow frame assembly having a lift arm assembly and a push frame;

a plow blade carried by the plow frame assembly;

an actuator configured to move the plow blade up and down; and a down pressure linkage coupled to the plow frame assembly;

wherein the down pressure linkage is directly coupled to the lift arm assembly and directly coupled to the push frame;

wherein the down pressure linkage applies a downward force to the plow blade upon actuating the actuator to move the plow blade down; and wherein the down pressure linkage simultaneously allows the plow blade to move upward upon an upward force being applied to the plow blade.

2. The plow system of claim 1, wherein the actuator is a hydraulic cylinder coupled between the lift arm assembly and the push frame.

3. The plow system of claim 1, wherein the down pressure linkage is a coil over gas shock.

4. The plow system of claim 1, wherein the down pressure linkage is pivotably coupled to the plow frame assembly between a first pivot point and a second pivot point.

5. The plow system of claim 4, wherein when the plow is in a raised condition, the down pressure linkage has a first length between the first pivot point and the second pivot point and wherein when the plow blade is in a lowered condition, the down pressure linkage has a second length between the first pivot point and the second pivot point, the first length being larger than the second length.

6. The plow system of claim 5, wherein upon the plow blade engaging an obstacle, the down pressure linkage has a third length between the first pivot point and the second pivot point, the second length being larger than the third length.

7. The plow system of claim 1, wherein the down pressure linkage provides a downward biasing force.

8. A plow system for use on a vehicle, comprising:

a plow frame assembly having a lift arm assembly and a push frame;

a plow blade carried by the plow frame assembly;

a hydraulic cylinder configured to move the plow blade up and down; and a coil over gas shock directly coupled to the lift arm assembly and directly coupled to the push frame;

wherein the coil over gas shock applies a downward force to the plow blade upon the plow blade engaging a surface while simultaneously allowing the plow blade to move upward upon an upward force being applied to the plow blade while engaging the surface.

9. The plow system of claim 8, wherein the downward force is generated upon compressing the coil over gas shock from a first length to a second length, the first length being larger than the second length.

10. The plow system of claim 9, wherein upon the plow blade engaging an obstacle on the surface, the coil over gas shock is further compressed to a third length, the second length being longer than the third length.

11. The plow system of claim 8, wherein the coil over gas shock provides downward biasing force to the plow blade.

12. The plow system of claim 8, wherein the hydraulic cylinder is pivotably coupled between the lift arm assembly and the push frame.

13. The plow system of claim 12, further comprising a plow bumper, the lift arm assembly and the push frame each being pivotably coupled to the plow bumper.

14. A plow system for use on a vehicle, comprising:

a plow bumper;

a push frame pivotably coupled to the plow bumper;

a lift arm assembly pivotably coupled to the plow bumper;

a plow blade carried by the push frame;

an actuator pivotably coupled between the lift arm assembly and the push frame, the actuator configured to move the plow blade up and down; and a down pressure linkage pivotably coupled directly to the lift arm assembly and directly to the push frame;

wherein the down pressure linkage applies a downward force to the plow blade upon the plow blade engaging a surface while simultaneously allowing the plow blade to move upward while the downward force of the down pressure linkage is being applied upon an upward force being applied to the plow blade from the surface.

15. The plow system of claim 14, wherein the actuator is a hydraulic cylinder.

16. The plow system of claim 14, wherein the down pressure linkage is a coil over gas shock.

17. The plow system of claim 14, wherein the down pressure linkage has a first length upon the plow blade contacting the surface and has a second length upon applying the downward force to the plow blade with the down pressure linkage, the first length being larger than the second length.

18. The plow system of claim 17, wherein the down pressure linkage has a third length upon the down pressure linkage rebounding, the third length being less than the second length.

* * * * *